US010360881B2

(12) United States Patent
Shigenaga

(10) Patent No.: US 10,360,881 B2
(45) Date of Patent: Jul. 23, 2019

(54) FOOT PEDAL APPARATUS FOR DRUM

(71) Applicant: YAMAHA CORPORATION, Hamamatsu-shi (JP)

(72) Inventor: Fumihiro Shigenaga, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/455,926

(22) Filed: Mar. 10, 2017

(65) Prior Publication Data

US 2017/0278491 A1 Sep. 28, 2017

(30) Foreign Application Priority Data

Mar. 25, 2016 (JP) ..... 2016-061835

(51) Int. Cl.
*G10D 13/00* (2006.01)

(52) U.S. Cl.
CPC ..... *G10D 13/006* (2013.01)

(58) Field of Classification Search
USPC ..... 84/422.1
See application file for complete search history.

(56) References Cited

U.S. PATENT DOCUMENTS 1,343,164 A 6/1920 Smith
4,200,025 A 4/1980 Currier
4,691,612 A 9/1987 Smith
5,365,824 A * 11/1994 Hoshino ..... G10D 13/006 84/422.1
5,565,637 A 10/1996 Shigenaga
5,798,472 A 8/1998 Shigenaga
(Continued)

FOREIGN PATENT DOCUMENTS

EP 0744732 A2 11/1996
JP S52157819 U1 11/1977
(Continued)

OTHER PUBLICATIONS

Extended European Search Report issued in European Appln. No. 17161344.1 dated Aug. 28, 2017.
(Continued)

*Primary Examiner* — Christopher Uhlir
(74) *Attorney, Agent, or Firm* — Rossi, Kimms & McDowell LLP

(57) ABSTRACT

A drum foot pedal apparatus includes: a coil spring imparting resilient self-returning force to a foot board; a rod member (or an adjusting bolt) supported by a support section provided on a support post member; and a tension adjustment mechanism provided between the coil spring and the rod member. The tension adjustment mechanism includes a connection position adjustment section that interconnects the lower end of the coil spring and the rod member above the support post member, and that is constructed to permit adjustment of a connection position between the lower end of the coil spring and the rod member or the adjusting bolt at a position above the support section. Thus, it is possible to effectively prevent frictional wear of component parts and generation of noise and achieve an enhanced operability in the tension adjustment, with a simple construction having a minimized number of component parts.

12 Claims, 12 Drawing Sheets

(56) References Cited

U.S. PATENT DOCUMENTS

| | | | | |
|---|---|---|---|---|
| 5,817,962 | A | 10/1998 | Behrenfeld | |
| 5,932,824 | A | 8/1999 | Liao | |
| 5,936,177 | A | 8/1999 | Shigenaga | |
| 5,945,616 | A | 8/1999 | Hoshino | |
| 5,998,719 | A | 12/1999 | Chuang | |
| 6,028,259 | A | 2/2000 | Lombardi et al. | |
| 6,762,354 | B2 * | 7/2004 | Cocca | G10D 13/006 84/422.1 |
| 6,822,149 | B1 * | 11/2004 | Liao | G10D 13/006 84/422.1 |
| 6,894,210 | B1 | 5/2005 | Lombardi | |
| 7,122,730 | B2 | 10/2006 | Takegawa | |
| 7,301,088 | B2 * | 11/2007 | Chen | G10D 13/006 84/422.1 |
| 7,626,108 | B1 | 12/2009 | Takegawa | |
| 7,692,084 | B1 * | 4/2010 | Lai | G10D 13/006 84/422.1 |
| 7,754,953 | B2 * | 7/2010 | Takegawa | G10D 13/006 285/87 |
| 7,795,520 | B1 * | 9/2010 | Chen | G10D 13/006 84/422.1 |
| 7,855,331 | B1 * | 12/2010 | Chen | G10D 13/006 84/422.1 |
| 8,633,367 | B2 | 1/2014 | Steinhauser et al. | |
| 8,686,265 | B2 * | 4/2014 | Johnston | G10D 13/006 84/422.1 |
| 8,859,871 | B2 | 10/2014 | Liao | |
| 9,236,038 | B1 | 1/2016 | Hirasawa | |
| 2002/0152873 | A1 | 10/2002 | Shigenaga | |
| 2005/0016358 | A1 | 1/2005 | Wise | |
| 2012/0198984 | A1 | 8/2012 | Johnston | |

FOREIGN PATENT DOCUMENTS

| | | | |
|---|---|---|---|
| JP | H0895557 | A | 4/1996 |
| JP | 2806301 | B2 | 9/1998 |
| JP | 3584898 | B2 | 11/2004 |
| JP | 2016095379 | A | 5/2016 |

OTHER PUBLICATIONS

Office Action issued in U.S. Appl. No. 15/278,781 dated Jan. 18, 2017.

Office Action issued in U.S. Appl. No. 15/278,704 dated Nov. 18, 2016.

Notice of Allowance issued in U.S. Appl. No. 15/278,704 dated Mar. 13, 2017.

Copending U.S. Appl. No. 15/278,704, filed Sep. 28, 2016 (a copy is not included because the cited application is not yet available to the public and the Examiner has ready access to the cited application).

Copending U.S. Appl. No. 15/278,781, filed Sep. 28, 2016 (a copy is not included because the cited application is not yet available to the public and the Examiner has ready access to the cited application).

Office Action issued in Japanese Appln. No. 2016-061835 dated Apr. 9, 2019. English translation provided.

* cited by examiner

FOOT PEDAL APPARATUS FOR DRUM

BACKGROUND

The present invention relates generally to a foot pedal apparatus for a drum (hereinafter referred to also as "drum foot pedal apparatus") which causes generation of a tone by pivoting a beater, in response to depression of a foot board, to thereby strike a drum with the beater.

Drum foot pedal apparatus have been known which generate a tone by pivoting a beater, in response to depression of a foot board, to thereby strike a drum head with the head of the beater. The conventionally-known drum foot pedal apparatus, as disclosed for example in Japanese Patent No. 2806301, include a pivot shaft having the beater mounted thereto, a pair of left and right support posts pivotably supporting the pivot shaft, and a transmission member, such as a chain, interconnecting the distal end of the foot board and the pivot shaft. According to the disclosure of the above-identified Japanese patent, a coil spring for normally urging or biasing the foot board toward an initial (non-depressed) position of the foot board (in other words, for imparting resilient self-returning force to the foot board) is connected to either or both of the opposite end portions of the pivot shaft. The coil spring is engaged at its upper end by a roller, via a link member, that is in turn rotatably supported on a crank arm, and the coil spring is engaged at its lower end in a through-hole of an adjusting screw (bolt).

Further, according to the disclosure of the above-identified Japanese patent, a tension adjustment mechanism is provided for adjusting the position of the adjusting screw. As shown for example in FIG. 6 of the above-identified Japanese patent, the tension adjustment mechanism comprises an adjusting nut for moving the adjusting screw upward or downward relative to a screw mounting member through rotation of the adjusting nut, and a locking nut for preventing loosening of the adjusting nut. The tension of the coil spring is adjustable by a human player or operator rotating the adjusting nut to thereby move the adjusting screw upward or downward.

Namely, the aforementioned coil spring tension adjustment mechanism allows the human player or operator to adjust the tension of the coil spring by operating the nut disposed on a lower end portion of the adjusting screw. As described for example in paragraph 0014 of the above-identified Japanese patent, in response to the human player or operator rotating the nut while holding a large-diameter portion of the nut with fingers, the adjusting screw moves along a screw hole (threaded hole) of the nut upward or downward, depending on the rotating direction of the nut, to thereby effect adjustment of the tension of the spring. Furthermore, Japanese Patent No. 3584898 discloses that the tension of a coil spring is adjusted by the human player or operator rotating an adjusting screw disposed below a bracket (support section).

In playing the drum with the foot pedal apparatus constructed in the aforementioned manner, the pivot shaft pivots via the transmission member in response to the human player depressing the foot board, so that the beater swings toward the drum head. Because, in response to the swing of the beater, the crank arm too moves upward with its distal end swinging upward, the coil spring engaged by the roller is expand, so that a load by the tension of the coil spring increases.

Furthermore, techniques related to drum foot pedal apparatus are also disclosed in U.S. Pat. Nos. 6,894,210, 9,236, 038 corresponding to Japanese Patent Application Laid-open Publication No. 2016-95379, etc.

Because the coil spring tension adjustment mechanism employed in the aforementioned foot pedal apparatus is constructed to adjust the coil spring tension in response to the human player or operator operating the nut disposed on a lower end portion of the adjusting bolt as noted above, the bolt, the arm, the coil spring, etc. would get in the way of the tension adjusting operation and thus make it difficult to for the human player or operator to operate the nut, if the pedal apparatus is left placed on the floor. Although the nut can also be operated with the pedal apparatus tilted downward, extra operations for detaching the pedal from the drum etc. are required, and thus, such an operation of the nut is difficult to perform particularly in a case where the pedal apparatus is of a twin-pedal construction.

Further, an example of a support structure for supporting the coil spring in the aforementioned foot pedal apparatus is conventionally known in which the coil spring is engaged at its lower end by the distal end of a metal rod. However, with such a conventionally-known coil spring support structure, where the coil spring is engaged at its lower end by the distal end of a metal rod, durability of the foot pedal apparatus would decrease due to frictional wear resulting from sliding contact between respective metal engaging portions of the coil spring's lower end and the metal rod, and performance-related inconveniences may occur due to noise generated by the sliding contact.

As measures for avoiding the aforementioned inconveniences, it has been known to provide a rotation structure on the engaging portion located at the lower end of the coil spring such that sliding between the metal engaging portions caused due to swinging movement as the coil spring expands and contracts can be reduced but also excessive force can be prevented from acting on the adjusting screw due to the swinging movement. However, such measures are unsatisfactory in that the provision of the rotation structure at the lower end of the coil spring would increase the number of necessary component parts and complicate the construction of the foot pedal apparatus and accordingly increase the manufacturing cost of the apparatus.

SUMMARY OF THE INVENTION

In view of the foregoing prior art problems, it is an object of the present invention to provide an improved pedal apparatus for a drum which can greatly facilitate a tension adjusting operation.

In order to accomplish the above-mentioned object, the present invention provides an improved drum foot pedal apparatus, which comprises: a support post member that supports a pivot shaft having a beater mounted thereto; a connection member that interconnects the pivot shaft and a foot board; an arm section provided on one end portion of the pivot shaft; a coil spring mounted to the arm section for imparting resilient self-returning force to the foot board; and a tension adjustment mechanism provided between the coil spring and the support post member for adjusting tension of the coil spring, the tension adjustment mechanism including a connection position adjustment section that is supported by the support post member and connected with a lower end of the coil spring above a support position (supported position) where the connection position adjustment section is supported by the support post member, and that is constructed to permit adjustment of a connection position (connected position) between the connection position adjustment section and the lower end of the coil spring at a position above the support position.

According to such a drum foot pedal apparatus of the present invention, the connection position adjustment section is connected with the lower end of the coil spring above the support position and permits adjustment of the connection position between the tension adjustment mechanism and the lower end of the coil spring (i.e., adjustment of a distance from the support position to the connection position) at a position above (higher than) the support position. Thus, a human player or operator (user) can perform an operation for adjusting the tension of the coil spring above (at a position higher than) the support position where the connection position adjustment section is supported by the support post member; in this way, the present invention allows the tension adjusting operation to be performed with an increased ease. As a result, the drum foot pedal apparatus of the present invention allows the human player or operator to perform the operation for adjusting the resilient self-returning force imparted to the foot board with ease as compared to the conventionally-known counterpart where the operating member disposed below the support section (below the center of pivot relative to the support post) is operated by the human player or operator.

In one embodiment of the invention, the tension adjustment mechanism includes a rod member supported at one end by the support post member, and the connection position adjustment section is movable and selectively positionable along the rod member. As an example, the rod member is an adjusting bolt. As compared to the conventionally-known technique where the rotation structure is provided at the lower end of the coil spring, the foot pedal apparatus of the present invention allows the coil spring to swing smoothly and reliably and thus can secure reliable and satisfactory behavior and operability of the foot board, although it is of a simple and inexpensive construction with a small number of component parts.

Further, in one embodiment of the invention, the connection position adjustment section may include: a connection member connected with the lower end of the coil spring and mounted on the adjusting bolt for movement along the adjusting bolt; and an adjusting nut threadedly engaging with a portion of the adjusting bolt above the connection member.

In such an embodiment of the invention, the connection member is normally urged or biased upward by the coil spring so as to constantly follow a position change of the adjusting nut disposed above the connection member, so that the human player or operator can adjust a position, along the adjusting bolt, of the connection member by adjusting the position at which the adjusting nut threadedly engages with the adjusting bolt. Thus, the mounted position of the connection member relative to the adjusting bolt can be adjusted by operating the adjusting nut; in this way, the connection position between the coil spring and the adjusting bolt can be adjusted through a simple operation. Particularly, by the connection position adjustment section being disposed above the support position where the adjusting bolt is supported by the support post member and by the adjusting nut being disposed above the connection member, the adjustment of the resilient self-returning force imparted to the foot board can be performed by operating the adjusting nut from above. As a result, the human player or operator's operation for adjusting the resilient self-returning force imparted to the foot board can be performed with an even further increased ease.

Further, in one embodiment of the invention, the connection member may include: an annular body section mounted around the outer periphery of the adjusting bolt; and an engaging section formed in the outer peripheral surface of the body section and engaging a hook portion of the coil spring. Thus, with a simple construction having a minimized number of component parts, it is possible to realize the connection adjustment section which allows the connection position between the coil spring and the connection member to be easily adjusted to any desired position.

Further, in one embodiment of the invention, the connection position adjustment section may include a positional displacement prevention mechanism that prevents positional displacement of the connection member relative to the adjusting bolt.

Further, in one embodiment of the invention, the positional displacement prevention mechanism may include a projection section provided on any one of the adjusting nut and an abutment member abutting against the adjusting nut, and a groove section provided in the other of the adjusting nut and the abutment member, and the positional displacement prevention mechanism is a mechanism that prevents rotation of the adjusting nut and positional displacement of the connection member by the projection section fitting in the groove section as long as the adjusting nut is held at a predetermined rotational angle position.

Such an embodiment of the invention can effectively prevent rotation of the adjusting nut and prevent positional displacement, in the axial direction, of the connection member, with a simple construction having a minimized number of component parts. Further, because the projection section fits in the groove section as long as the adjusting nut is held at a predetermined rotational angle position as noted above, positional displacement of the connection member can be reliably prevented, by the human player or operator merely rotating the adjusting nut to a rotational angle position where the projection section fits in the groove section.

Further, in one embodiment of the invention, the positional displacement prevention mechanism may include a retaining nut provided opposite the adjusting nut in the axial direction of the adjusting bolt with respect to the connection member, and the positional displacement prevention mechanism is a mechanism that prevents positional displacement of the connection member by sandwiching the connection member between the adjusting nut and the retaining nut. Because the connection member is sandwiched between the adjusting nut and the retaining nut, it is possible to effectively prevent positional displacement of the connection member, even with a simple construction.

Further, in one embodiment of the invention, the drum foot pedal apparatus may further comprise a pivot point section provided between the rod member and the support post member so that the adjusting bolt pivots about the pivot point section as the coil spring expand and contracts in response to pivoting of the arm section.

With such arrangements, the coil spring and the adjusting bolt together pivot or swing together about the pivot point section as the coil spring expands and contracts in response to a depressing operation performed on the foot board. In this way, sliding movement of various members caused by the expansion and contraction of the coil spring can be effectively reduced. Thus, frictional wear of the various members can be minimized, but also reliable and satisfactory behavior of the foot board and the coil spring can be secured. Besides, it is possible to effectively prevent noise, such as squeak noise, from being generated in response to a depressing operation on the foot board.

Further, in one embodiment, the connection position adjustment section may include: a connection member connected with the lower end of the coil spring and constructed to be movable along the rod member; and a positioning member that positions the connection member at a desired position along the length of the rod member. The positioning member may comprise a combination of a pin and a plurality of pin insertion holes.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

First Embodiment

Figure 1:
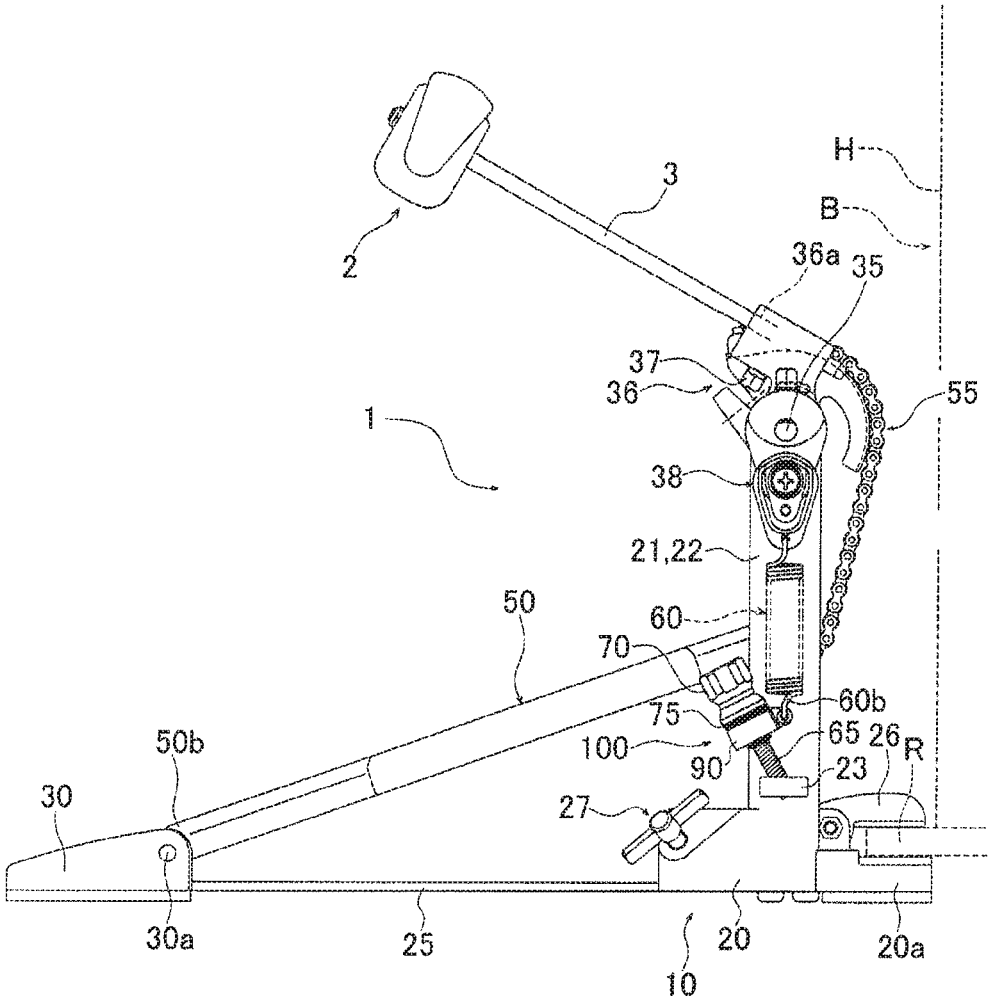
FIG. 1 is a side view showing an overall construction of a drum foot pedal apparatus according to a first embodiment of the present invention.
Figure 2:
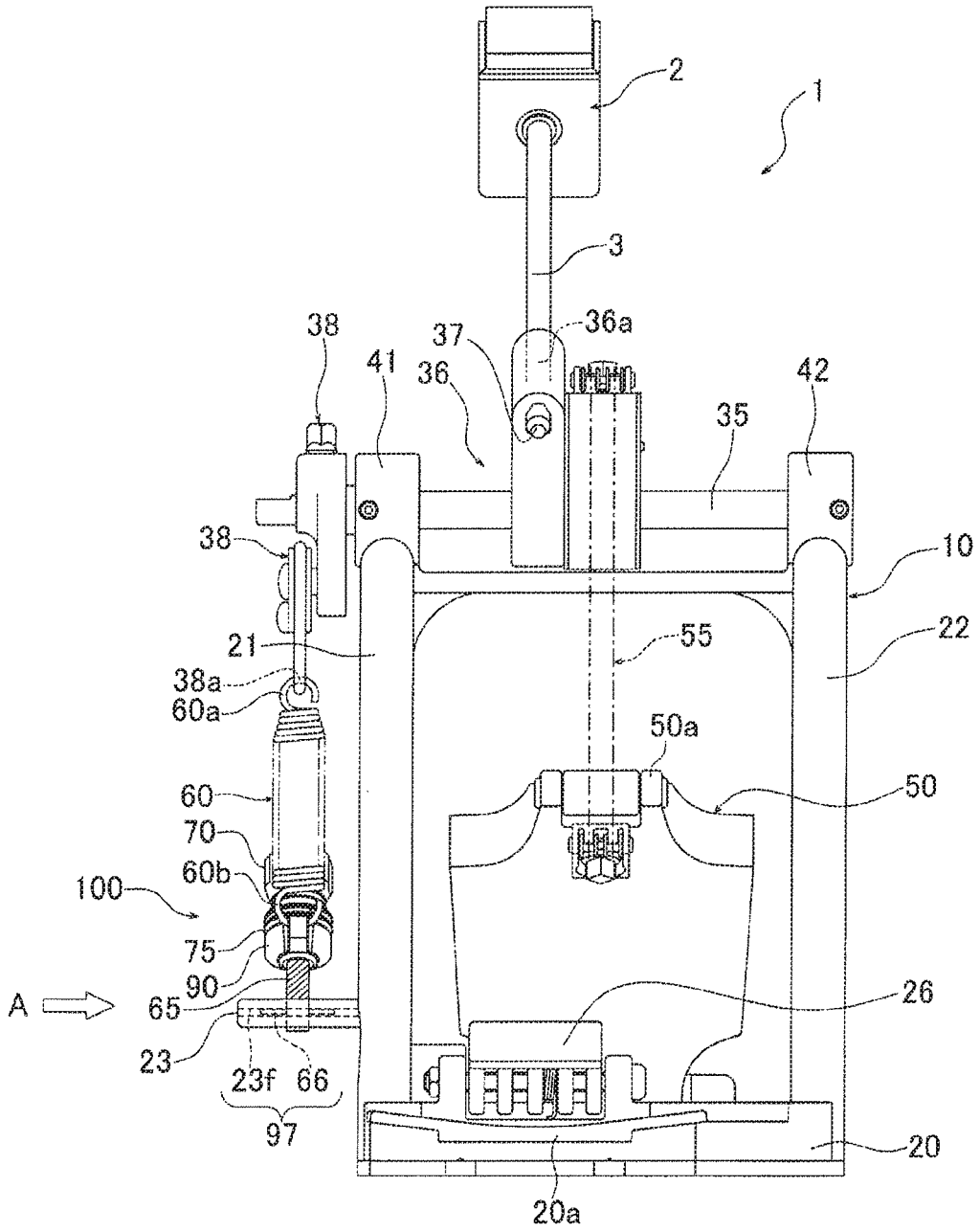
FIG. 2 is a front view of the drum foot pedal apparatus shown in FIG. 1.
Figure 3:
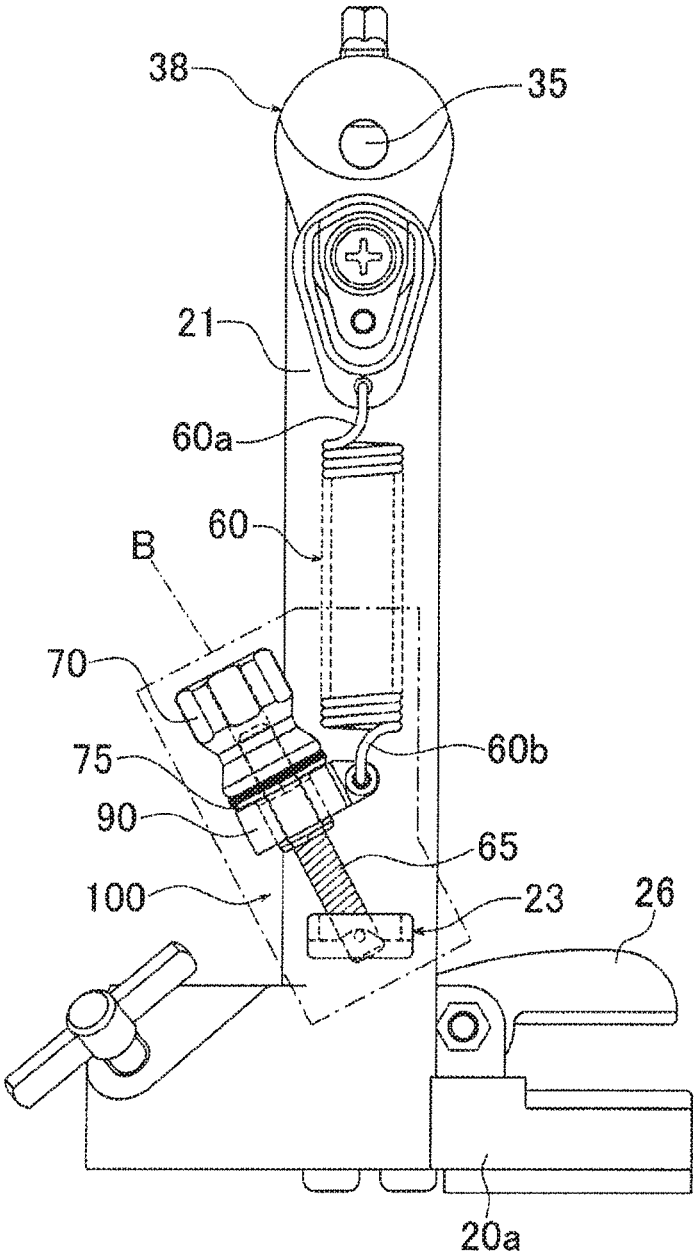
FIG. 3 is a view of the drum foot pedal apparatus taken in a direction of arrow A of FIG. 2.
Figure 4:
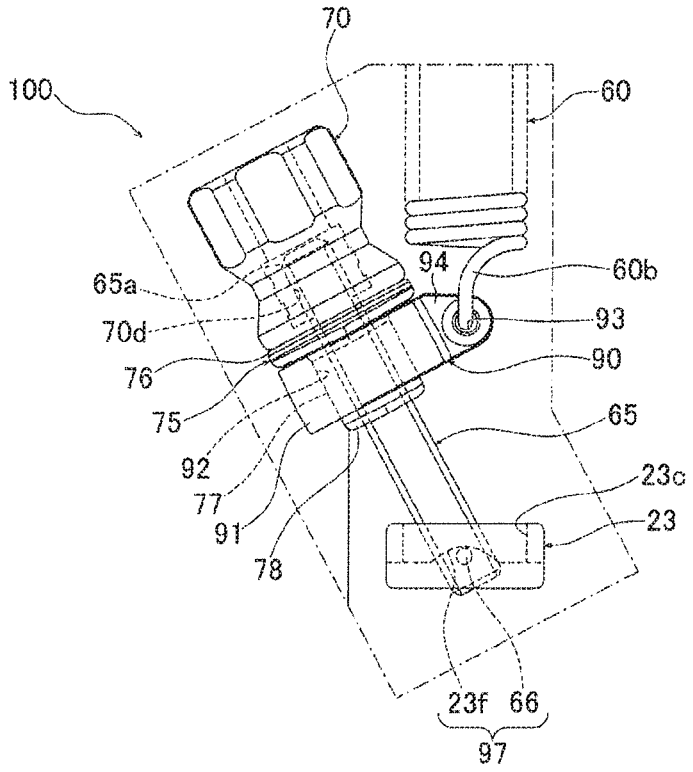
FIG. 4 is an enlarged fragmentary view of a section B of FIG. 3

FIG. 1 is a side view showing an overall construction of a drum foot pedal apparatus according to a first embodiment of the present invention, and FIG. 2 is a front view of the drum foot pedal apparatus shown in FIG. 1. FIG. 3 is a view of the drum foot pedal apparatus taken in a direction of arrow A of FIG. 2, and FIG. 4 is an enlarged fragmentary view of a section B of FIG. 3.

The drum foot pedal apparatus 1 shown in FIGS. 1 and 2 includes a frame section 10 placed on a floor surface (installing surface) of an installation site. The frame section 10 includes a base section 20, a pair of left and right support post members 21 and 22 provided on and projecting upward from the upper surface of the base section 20, and a heel member 30 connected to a rear end portion of the frame section 10 via a base member 25. To a front portion of the base section 20 are mounted a clamp 26 for vertically sandwiching a hoop R of a bass drum B, and a hoop fixing screw 27 for pressing the clamp 26 against the hoop R. By the hoop fixing screw 27 being tightened, the clamp 26 vertically sandwiches the hoop R of the bass drum B in conjunction with a front end portion 20*a* of the base section 20 to thereby fix the foot pedal apparatus 1 to the bass drum B.

A pivot shaft 35 is pivotably supported on respective upper end portions of the left and right support post members 21 and 22. A rocker 36 is mounted on an axially middle portion of the pivot shaft 35, and opposite end portions of the pivot shaft 35 are pivotably supported by bearings 41 and 42 incorporated in the upper end portions of the left and right support post members 21 and 22. A beater head 2 for striking a drum head H of the bass drum B is mounted to the rocker 36 via a beater rod 3, and a connection member 55 for transmitting depressing force applied to a foot board 50 to the beater head 2 as a part of a driving force transmission mechanism is fixed at its upper end portion to the rocker 36. The beater rod 3 has a base or proximal end portion slidably fittingly inserted in a through-hole 36*a* formed in the rocker 36 and fixed in the through-hole 36*a* by means of a bolt 37. It is possible to change a position, in a height direction, of the drum head H at which the beater head 2 strikes the drum head H (i.e., a height position at which the drum head H is struck by the beater head 2, or drum-head striking height position), by loosening the bolt 37 and adjusting a length of a portion of the beater rod 3 projecting obliquely upward from the rocker 36. Although a metal chain is used as the connection member 55 in the illustrated example, a band formed of leather or synthetic resin or the like may be used as the connection member 55. The driving force transmission mechanism for transmitting depressing force applied to the foot board 50 to the beater head 2 may be one using a link mechanism or the like without being limited to the aforementioned one using the chain or belt. Like in the instant first embodiment, any desired form of driving force transmission mechanism may be used in later-described other embodiments and modifications.

The foot board 50 is formed of a flat plate having a size large enough for a human player to place thereon his or her foot, and the foot board 50 is connected at its front end portion 50*a* to a lower end portion of the connection member 55 and connected at its rear end portion 50*b* to the heel member 30 in such a manner that it is pivotable vertically in an up-down direction about a pivot shaft 30*a*.

Further, the foot board 50 is normally urged or biased by a coil spring 60 in a counterclockwise direction in FIG. 1, i.e. toward its initial non-depressed position; that is, the foot board 50 is imparted by the coil spring 60 with resilient self-returning force acting in the counterclockwise direction in FIG. 1. The coil spring 60, which is disposed along the outer side surface of one of the support post members 21, has an upper hook portion 60*a* engaged by an arm member or section 38 provided on one end portion of the pivot shaft 35, and a lower hook portion 60*b* connected via a tension adjustment mechanism 100 to a support section 23 provided on and projecting from a near-lower-end portion of the support post member 21 as will be described later in greater detail.

Figure 5:
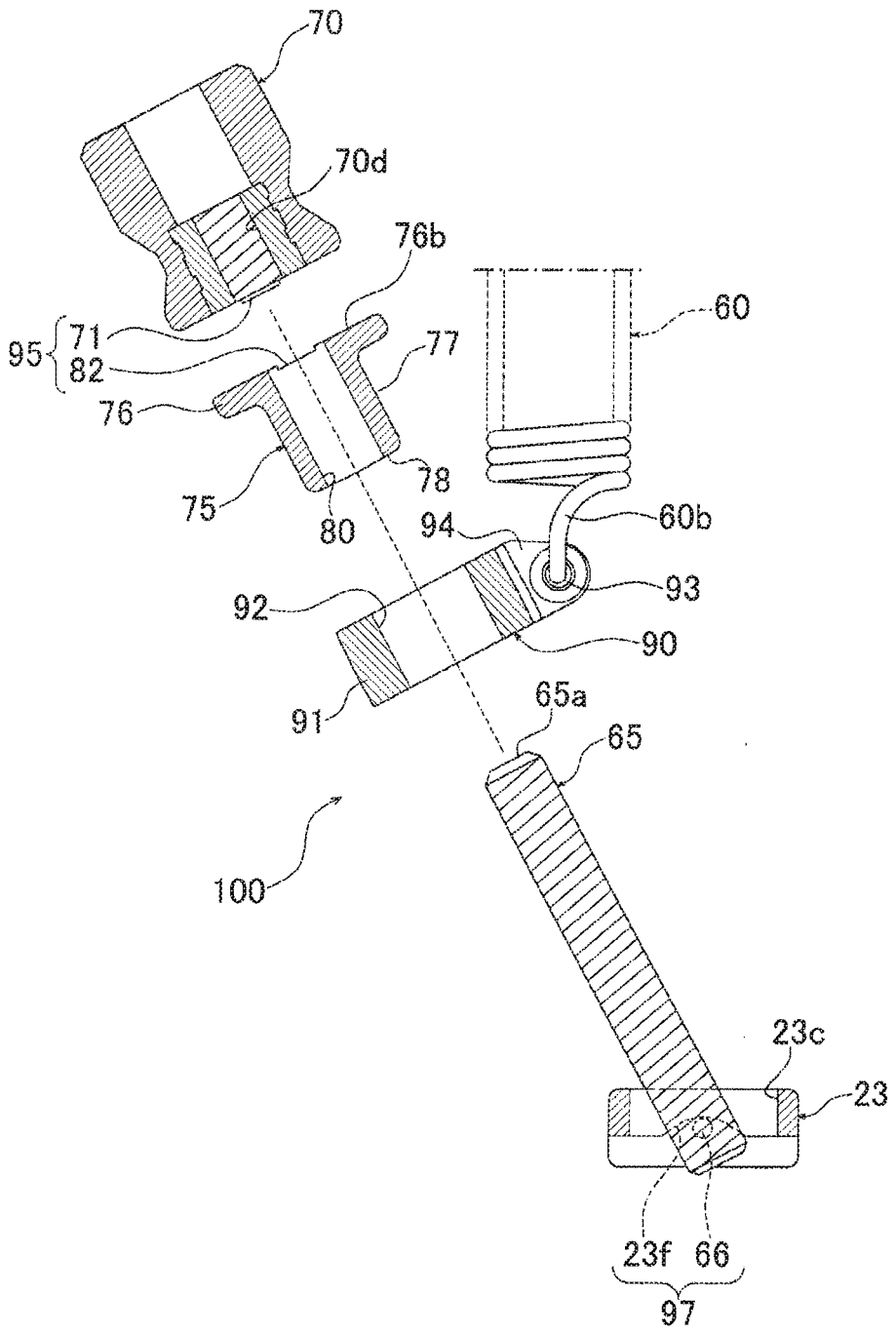
FIG. 5 is an exploded sectional side view showing various component parts of a tension adjustment mechanism provided in the drum foot pedal apparatus.

FIG. 5 is an exploded sectional side view showing various component parts of the tension adjustment mechanism 100. The tension adjustment mechanism 100, which is provided between the coil spring 60 and the support post member 21 for adjusting the tension of the coil spring 60, includes a connection position adjustment section. The connection position adjustment section is supported by the support post member 21, connected to the lower end of the coil spring 60 above the position (support position) where it is supported by the support post member 21, and constructed to permit adjustment of the connection position between the lower end of the coil spring 60 and the connection position adjustment section. More specifically, the tension adjustment mechanism 100 includes the adjusting bolt (or rod member) 65 supported at one end by the support post member 21, and the connection position adjustment section is constructed to be movable and selectively positionable along the length of the adjusting bolt (or rod member) 65. Still more specifically, the connection position adjustment section is disposed above the support section provided on and projecting from a predetermined position of the support post member 21, and a component part (more particularly, a later-described connection ring 90) of various component parts of the adjustment section is connected to the lower end of the coil spring 60.

The connection position adjustment section comprises: the adjusting bolt 65 pivotably supported by the support section provided on the support post member 21; the connection ring (connection member) 90 having the lower hook portion 60*b* of the coil spring 60 connected thereto and mounted on the adjusting bolt 65 via a slide bush (bush member) 75; and an adjusting nut 70 screwed onto, or threadedly engaging with, the adjusting bolt 65 for adjusting a mounted position (axial position) of the connection ring 90 relative to the adjusting bolt 65.

The adjusting bolt 65 is a metal rod-shaped member threaded on its outer peripheral surface. Further, the adjusting bolt 65 has a pin 66 of a small-diameter columnar shape formed on a lower end portion of the adjusting bolt 65 and projecting in opposite radially outward directions from opposite peripheral surface portions of the lower end portion of the adjusting bolt 65. By the pin 66 abutting against receiving portions 23*f* of the support section 23, the pin 66 and the receiving portions 23*f* together constitute an abutment section (pivot point section) 97. As described later, the adjusting bolt 65 and the adjusting nut 70 mounted thereon swing together in the front-rear direction of the foot board 50 about the abutment section 97. Namely, the adjusting bolt 65 is pivotably supported at its one end by the support post member 21.

Figure 6:
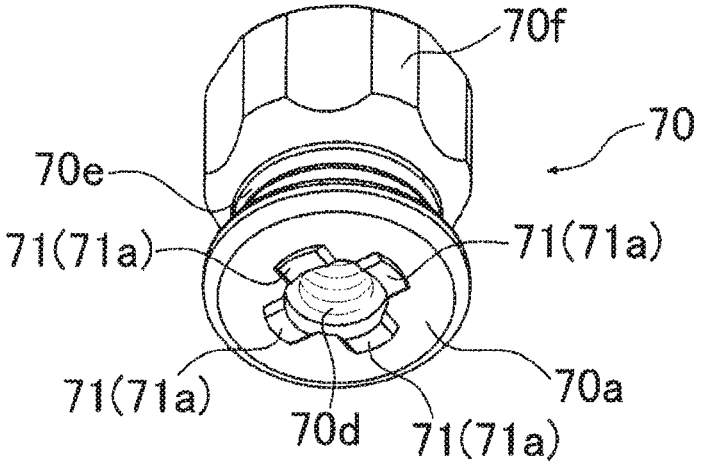
FIG. 6 is a perspective view of an adjusting nut in the tension adjustment mechanism.

FIG. 6 is a perspective view of the adjusting nut 70. The adjusting nut 70 is a substantially columnar member having a screw hole 70*d* formed through the axis thereof for threaded engagement with the adjusting bolt 65. Further, the adjusting nut 70 has a radially inwardly narrowed section 70*e* formed along the circumference of a lower outer peripheral surface region thereof, and an operating section 70*f* in the form of alternating recesses and projections formed upwardly of the narrowed section 70*e* for preventing slippage of fingers of a human player or operator when rotating the adjusting nut 70. The adjusting nut 70 also has a flat lower end surface 70*a*, and a projection section 71 is formed in the lower surface 70*a* along the circumferential outer edge of the screw hole 70*d*. More specifically, the projection section 71 comprises four projections 71*a* formed at equal intervals of 90 degrees along the edge of the screw hole 70*d* and in a crisscross shape centered at the screw hole 70*d*. The projection section 71 is fittingly engageable in a groove section 82 formed in the upper surface 76*b* of the slide bush 75 (base section 76) as will be described later.

Figure 7:
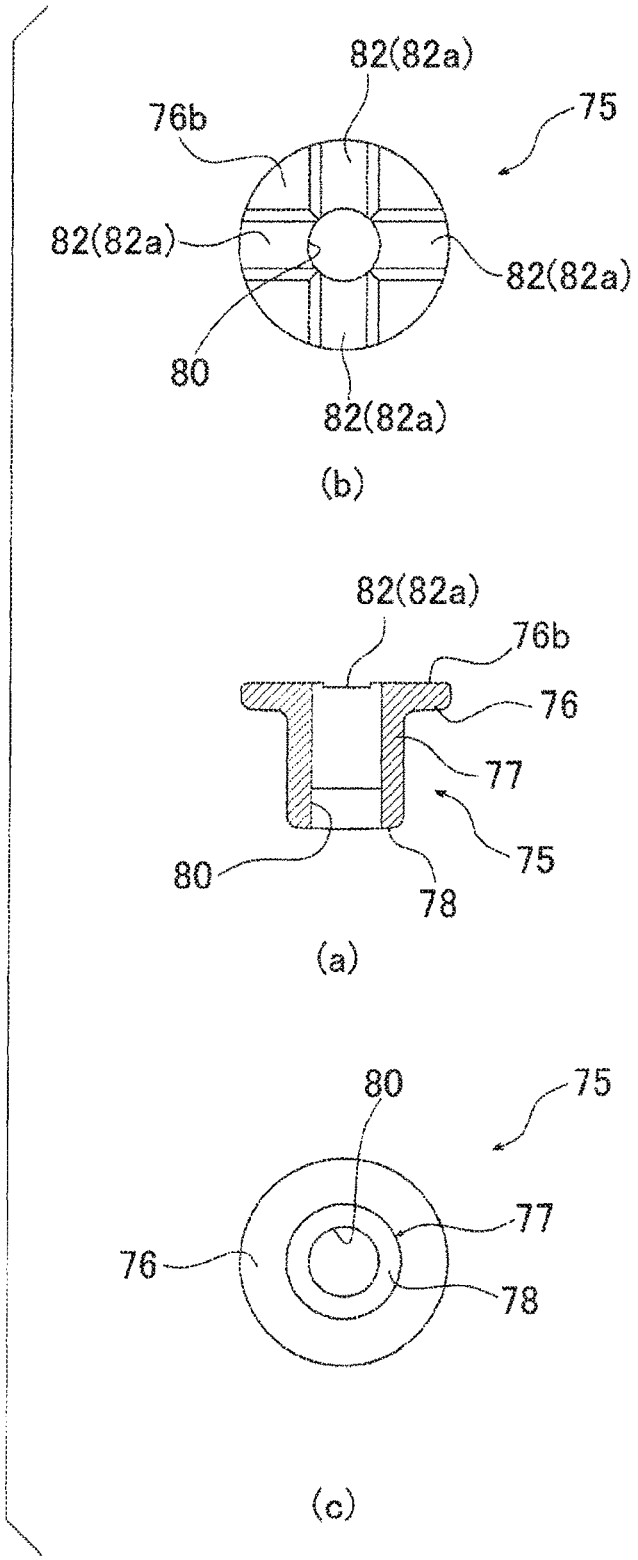
FIG. 7 is a view of a slide bush in the tension adjustment mechanism.

FIG. 7 shows the slide bush 75, of which (a), (b) and (c) are a side view, plan view and bottom view, respectively, of the slide bush 75. The slide bush 75, which is integrally formed of synthetic resin, includes the base section 76, and a shaft section 77 formed integrally with the lower end of the base section 76. The base section 76 is a section of a substantially thin plate shape having a substantially circular contour corresponding to that of the adjusting nut 70. The shaft section 77 is a section formed in a substantially columnar shape extending from the base section 76 to the lower end 78 thereof. The slide bush 75 has an axial through-hole 80 extending from the upper surface 76*b* of the base section 76 through the shaft section 77 down to the lower end 78. The slide bush 75 is mounted on the adjusting bolt 65 in such a manner that it is slidingly movable along the axis or length of the adjusting bolt 65. The groove section 82 in the form of a crisscross-shaped recess centered at the through-hole 80 is formed in the upper surface 76*b* of the slide bush base section 76. The groove section 82 comprises four grooves formed at intervals of 90 degrees and each extending radially outward from the through-hole 80 to the outer peripheral edge of the base section 76. The four projections 71*a* formed on the lower surface 70*a* of the adjusting nut 70 are fittingly engageable in corresponding ones of the grooves 82*a*.

Namely, the projection section 71 (projections 71*a*) of the adjusting nut 70 and the groove section 82 (grooves 82*a*) of the slide bush 72 together constitute a positional displacement prevention mechanism 95 for preventing rotation (in a loosening direction) of the adjusting nut 70 to thereby prevent axial positional displacement of the connection ring 90. Thus, as long as the adjusting nut 70 is located at a predetermined rotational angle position (i.e., 90-degree-by-90-degree rotational angle position), the positional displacement prevention mechanism 95 prevents loosening of the adjusting nut 70 by the fitting engagement between the projection section 71 and the groove section 82, thereby preventing axial positional displacement of the connection ring 90.

The connection ring (connection member) 90 includes: a body section 91 of a substantially annular shape having a central through-hole 92 of a circular cross section formed through the axis thereof and mounted around the outer periphery of the adjusting bolt 65; a flange section 94 in the form of a thin plate-shaped projection formed on and projecting from an outer surface portion of the body section 91; and an engaging hole (engaging portion) 93 formed in the flange section 94. The lower hook portion 60*b* of the coil spring 60 is engaged in the engaging hole 93.

Figure 8:
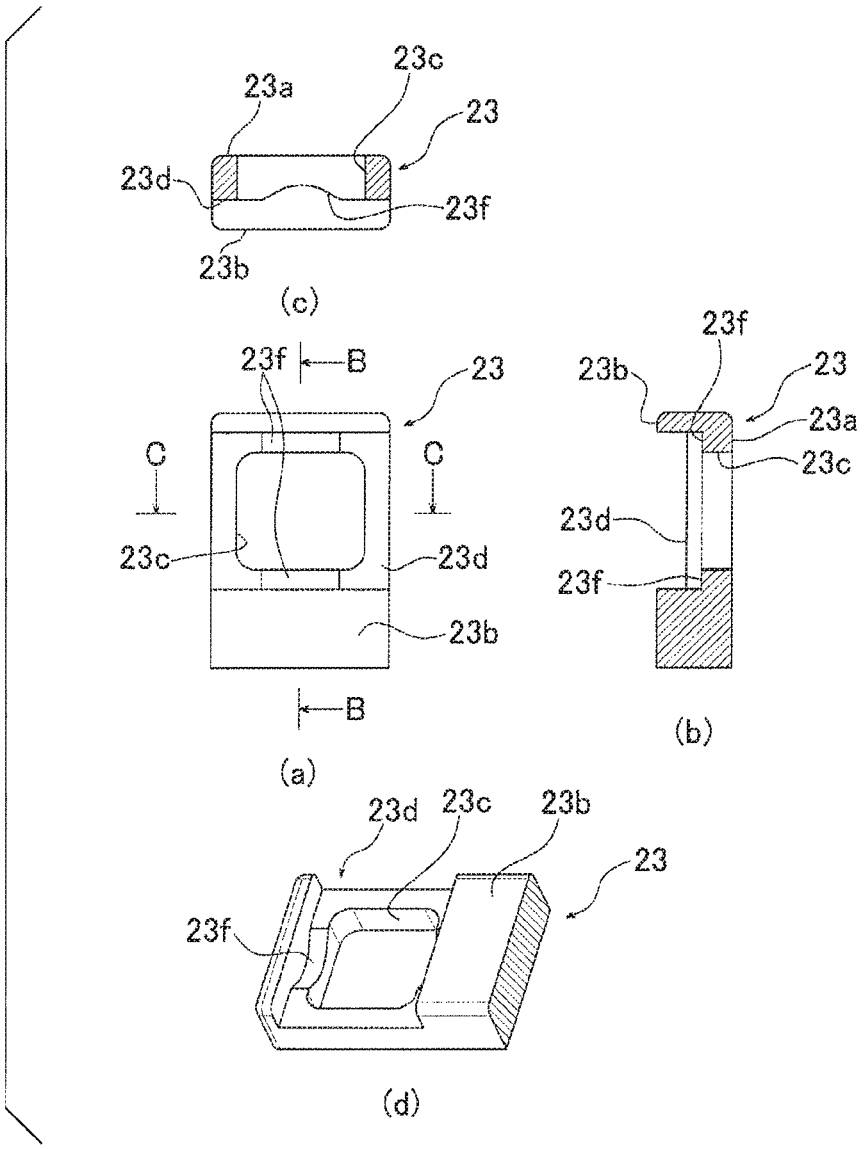
FIG. 8 is a view of a support section in the tension adjustment mechanism.

FIG. 8 shows the aforementioned support section 23, of which (a) is a bottom view of the support section 23, (b) is a sectional view taken along the B-B line of (a), (c) is a sectional view taken along the C-C line of (a), and (d) is a lower perspective view of the support section 23. The support section 23 is a section of a substantially flat, rectangular plate shape projecting laterally outward from a side surface portion of the support post member 21 in parallel to the installing surface of the foot pedal apparatus 1. The support section 23 has a recessed portion 23*d* of a substantially U cross-sectional shape formed in the upper surface 23*b* of the support section 23 and extending through the support section 23 in the front-rear direction. Further, an opening portion (communication portion) 23*c* in the form of a through-hole extending through the support section 23 in the up-down direction is formed in a substantially square shape in the bottom surface of the recessed portion 23*d*. The receiving portions 23*f* for receiving the above-mentioned pin 66 of the adjusting bolt 65 are formed as downwardly curved recesses in the bottom surface of the support section 23 adjacent to the opposite side edges (i.e., left and right side edges) of the opening portion 23*c*.

To assemble the tension adjustment mechanism 100 including the aforementioned component parts, the adjusting bolt 65 is inserted from below through the opening portion 23*c* of the support section 23 in such a manner that an upper end portion 65*a* of the adjusting bolt 65 projected upwardly beyond the upper surface of the support section 23. Further, the lower hook portion 60*b* of the coil spring 60 is brought into engagement in the engaging hole 93 of the connection ring 90 so that the connection ring 90 is connected with the lower end of the coil spring 60, and the shaft section 77 of the slide bush 75 is inserted through the through-hole 92 of the connection ring 90. After that, the adjusting bolt 65 is passed through the through-hole 80 of the slide bush 75, and the adjusting nut 70 is screwed onto the upper end portion 65*a* of the adjusting bolt 65 projecting beyond the upper surface 76*b* of the base section 76 of the slide bush 75. In this manner, assemblage of the tension adjustment mechanism 100 is completed.

In the assembled state of the tension adjustment mechanism 100, the connection ring 90 is kept pulled upward by the biasing force of the coil spring 60. Thus, the slide bush 75 is pushed upward so that the upper surface 76*b* of the slide bush 75 abuts against and presses the lower surface 70*a* of the adjusting nut 70. Thus, the adjusting bolt 65 with which the adjusting nut 70 is held in threaded engagement is pushed upward, so that the pin 66 of the adjusting bolt 65 abuts against the receiving portions 23*f* of the support section 23. With the pin 66 of the adjusting bolt 65 abutting against the receiving portions 23*f*, upward movement of the adjusting bolt 65 is restricted, and the adjusting bolt 65 is kept supported by the support section 23 in such a manner that it can swing or pivot relative to the support section 23 about the abutment section 97 (pin 66).

An axial position of the adjusting nut 70 relative to the adjusting bolt 65 can be adjusted by rotating the adjusting nut 70 about the adjusting bolt 65. Namely, rotating the adjusting nut 70 in the tightening direction can move the adjusting nut 70 and the connection ring 90 downward along the axis of the adjusting bolt 65. On the other hand, rotating the adjusting nut 70 in the loosening direction can move the adjusting nut 70 and the connection ring 90 upward along the axis of the adjusting bolt 65.

By rotating the adjusting nut 70 to adjust a height position of the connection member 90 relative to the adjusting bolt 65, it is possible to adjust the biasing force of the coil spring 60 acting on the foot board 50; in other words, it is possible to adjust reactive force acting on the foot board 50 in response to depression of the foot board 50 due to the biasing force of the coil spring 60.

Further, because the adjusting nut 70 is selectively positionable in its rotational direction for each of the rotational angle positions where the projection section 71 is fittingly engaged in the groove section 82, the adjusting nut 70 can be set at any desired one of the 90-degree-by-90-degree rotational angle positions. Thus, as long as the adjusting nut 70 is held at a predetermined rotational angle position (i.e., any one of the 90-degree-by-90-degree rotational angle positions), loosening of the adjusting nut 70 can be prevented by the fitting engagement between the projection section 71 and the groove section 82, and thus, axial positional displacement of the connection ring 90 can be prevented, as set forth earlier.

Namely, the tension adjustment of the coil spring 60 by the tension adjustment mechanism 100 is performed by the human player or operator rotating the adjusting nut 70 to move the connection ring 90 upward or downward until the coil spring 60 assumes desired tension. In this case, if the connection ring 90 is moved downward so that the tension of the coil spring 60 increases, the pivoting velocity of the pivot shaft 35 and the returning velocity of the foot board 50 after the beater head 2 has struck the drum head H increase. Conversely, if the connection ring 90 is moved upward so that the tension of the coil spring 60 decreases, the pivoting velocity of the pivot shaft 35 and the returning velocity of the foot board 50 after the beater head 2 has struck the drum head H decrease.

As the human player depresses the foot board 50 with his or her foot in the drum foot pedal apparatus 1 constructed in the aforementioned manner, the connection member 55 is pulled downward to cause the rocker 36 to pivot together with the pivot shaft 35, so that the beater head 2 strikes the drum head H of the bass drum B. Then, as the human player removes the depressing force from the foot board 50 (i.e., releases the foot board 50) after the beater head 2 has struck the drum head H, the pivot shaft 35 pivots in a direction, opposite the direction it pivoted at the time of the drum striking, by the tensile force of the coil spring 60, and thus, the beater head 2 and the foot board 50 return to their respective initial positions to thereby permit a next striking operation.

During that time, the arm section 38 pivots in the front-rear direction (left-right direction in FIG. 1) about the pivot shaft 35 in response to the foot board depressing and releasing operations, so that the upper end of the coil spring 60 swings in the front-rear direction and thus the coil spring 60 expands and contracts. Further, during that time, the lower end of the coil spring 60 and the upper end of the connection ring 90 too swing in the front-rear direction. Thus, the adjusting bolt 65, the adjusting nut 70 and the connection ring 90 together swing about the abutment section 97 relative to the support section 23.

As set forth above, with the foot pedal apparatus 1 of the present invention which includes, as the tension adjustment mechanism 100 for adjusting the tension of the coil spring 60, the connection position adjustment section which is connected to the lower end of the coil spring 60 above the abutment section 97 (support section 23) and adjusts the connection position between the coil spring 60 and the adjusting bolt 65 (or support section 23), it is possible to minimize the swing (pivot) angle of the coil spring 60 during the expansion and contraction of the coil spring 60 responsive to a depressing operation of the foot board 50. As a consequence, it is possible to secure smooth movement of the coil spring 60 and the foot board 50 and effectively minimize an energy loss and generation of noise that would be caused by sliding friction between respective connecting portions of the coil spring 60 and the adjusting bolt 65.

Furthermore, as compared to the conventionally-known technique where the rotation structure is provided at the lower end of the coil spring, the foot pedal apparatus 1 of the present invention allows the coil spring 60 to swing smoothly and reliably and thus can secure reliable and satisfactory behavior and operability of the foot board 50 although it is of a simple and inexpensive construction having only a smaller number of component parts.

Further, the aforementioned connection position adjustment section includes the connection ring (connection member) 90 having the lower end of the coil spring 60 connected thereto and mounted on the adjusting bolt 65, and the adjusting nut 70 screwed onto the portion of the adjusting bolt 65 projecting upward beyond the connection ring 90.

With the aforementioned arrangements, it is possible to adjust an assembled (mounted) position of the connection ring 90 relative to the adjusting bolt 65 by operating the adjusting nut 70, and thus, it is possible to adjust, through simple operation, the connection position between the coil spring 60 and the adjusting bolt 65. Particularly, because adjustment of resilient self-returning force imparted to the foot board 50 can be performed by operating the adjusting nut 70 located above the supported position (support position) of the adjusting bolt 65 relative to the support post member 21 (more particularly, the abutted position between the adjusting bolt 65 and the abutment section 97 or the support section 23). In this way, the pedal apparatus 1 allows the human player or operator to perform the operation for adjusting the resilient self-returning force imparted to the foot board 50 extremely easily as compared to the conventionally-known technique where the operating member disposed below the support section is operated by the human player or operator.

Further, the connection ring 90 in the embodiment of the drum foot pedal apparatus 1 includes the body section 91 of a substantially annular ring shape and mounted around the outer periphery of the adjusting bolt 65, and the engaging hole (engaging section) 93 formed in a portion of the outer periphery of the body section 91 and engaging the lower hook portion 60*b* of the coil spring 60. Thus, the instant embodiment can realize the connection position adjustment section which is of a simple construction having a minimized number of component parts and yet is capable of adjusting as desired the connection position between the coil spring 60 and the adjusting bolt 65.

Furthermore, the connection position adjustment section in the instant embodiment of the drum foot pedal apparatus 1 includes, as the construction for preventing positional displacement of the connection ring 90 relative to the adjusting bolt 65, the positional displacement prevention mechanism 95 comprising the projection section 71 provided on the adjusting nut 70 and the groove section 82 provided in the slide bush 75. Such a connection position adjustment section is constructed in such a manner that, as long as the adjusting nut 70 is held at a predetermined rotational angle position, positional displacement of the connection ring 90 can be prevented by the projection section 71 fitting in the groove section 82 so that rotation of the adjusting nut 70 is prevented.

Thus, with a simple construction minimized in the number of component parts, it is possible to prevent rotation of the adjusting nut 70 and thereby prevent axial positional displacement of the connection ring 90. Furthermore, with the arrangements where the projection section 71 fits in the groove section 82 as long as the adjusting nut 70 is held at a predetermined rotational angle position, positional displacement of the connection ring 90 can be prevented by the human player or operator merely performing the operation of rotating the adjusting nut 70 until the projection section 71 fits in the groove section 82.

Furthermore, the tension adjustment mechanism 100 in the instant embodiment, which includes the abutment section 97 where the pin 66 of the adjusting bolt 65 abuts against the receiving portions 23*f* of the support section 23, is constructed in such a manner that the adjusting bolt 65 pivots in the front-rear direction of the foot board 50 about the abutment section 97 as the coil spring 60 expands and contracts in response to pivoting of the arm section 38.

With such arrangements, the coil spring 60 and the adjusting bolt 65 together pivot or swing about the abutment section 97 as the coil spring 60 expands and contracts in response to a depressing operation performed on the foot board 50. In this way, sliding movement of various members caused by the expansion and contraction of the coil spring 60 can be effectively reduced. Thus, frictional wear of the various members can be minimized, but also reliable and satisfactory behavior of the foot board 50 and the coil spring 60 can be secured. Besides, it is possible to effectively prevent noise, such as squeak noise, from being generated in response to a depressing operation on the foot board 50.

Second Embodiment

Figure 9:
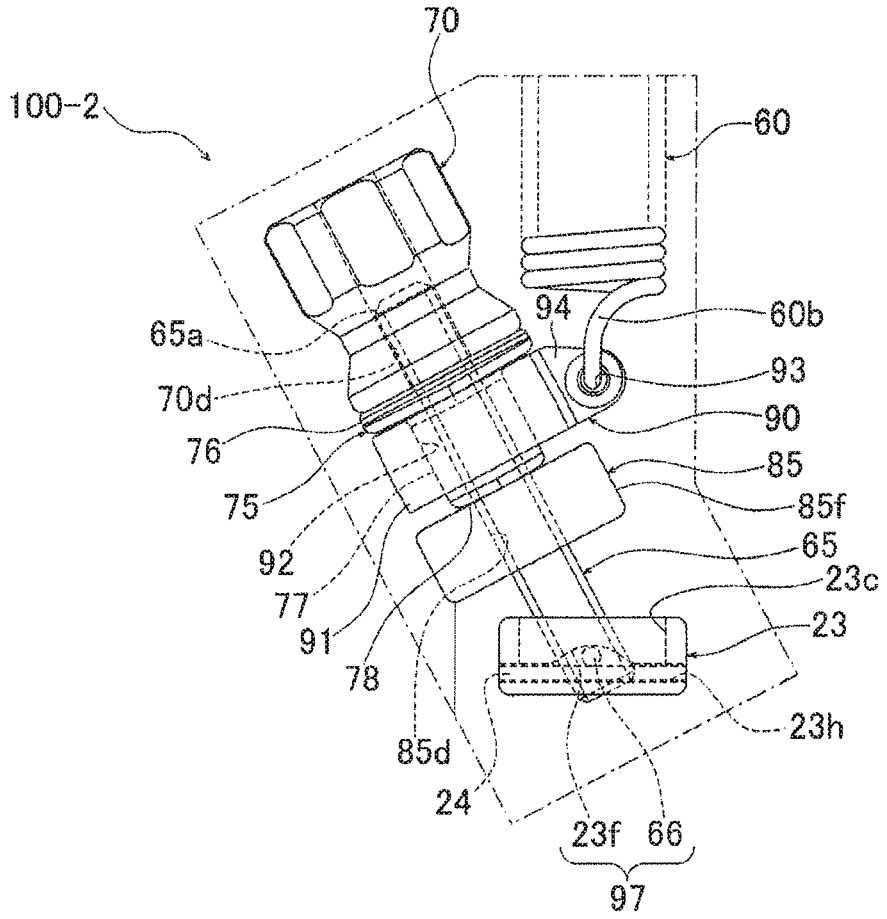
FIG. 9 is a view showing a tension adjustment mechanism provided in a second embodiment of the drum foot pedal apparatus of the present invention.
Figure 10:
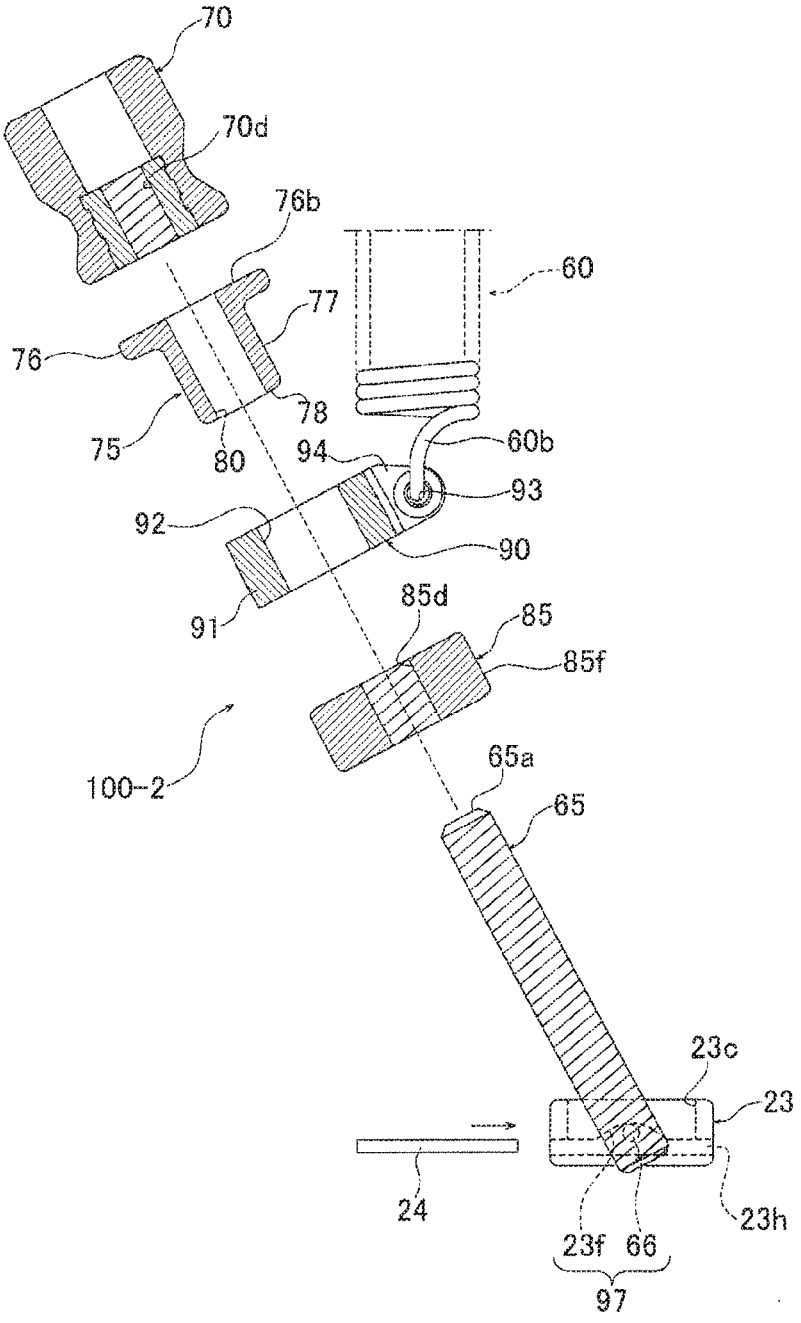
FIG. 10 is an exploded sectional side view showing various component parts of a tension adjustment mechanism in the second embodiment.

The following describe a second embodiment of the present invention with reference to FIGS. 9 and 10, where elements identical, similar or corresponding to those in the first embodiment are depicted by the same reference numerals as in the first embodiment and will not be described in detail to avoid unnecessary duplication. Note that features of the second embodiment other than those to be described below and shown in the figures are the same as the features described above in relation to the first embodiment. The same can be said of other embodiments to be described below.

FIG. 9 is a fragmentary enlarged view showing a tension adjustment mechanism 100-2 provided in the second embodiment of the drum foot pedal apparatus of the present invention, and FIG. 10 is an exploded sectional side view showing various component parts of the tension adjustment mechanism 100-2. In addition to the same component parts as employed in the tension adjustment mechanism 100 provided in the first embodiment, the tension adjustment mechanism 100-2 provided in the second embodiment of the drum foot pedal apparatus includes, as the positional displacement prevention mechanism for preventing positional displacement of the connection ring 90, a retaining nut 85 provided opposite the adjusting nut 70 in the axial direction of the adjusting bolt 65 with respect to the connection ring 90. More specifically, the adjusting nut 70 is held in abutment against the base section 76 of the slide bush 75, and the retaining nut 85 is held in abutment against the lower end 78 of the slide bush 75. In this manner, the connection ring 90 is sandwiched between the adjusting nut 70 and the retaining nut 85 via the slide bush 75 inserted through the through-hole 92 of the connection ring 90.

Note that the tension adjustment mechanism 100-2 in the second embodiment is not provided with the positional displacement prevention mechanism 95 that comprises the projection section 71 provided on the adjusting nut 70 and the groove section 82 provided in the slide bush 75.

The retaining nut 85, which is a thin, substantially circular columnar member, has a screw hole 85*b* formed through the axis thereof for threaded engagement with the adjusting bolt 65. An operating section 85*f* in the form of alternating recesses and projections is formed on the outer peripheral surface of the retaining nut 85 for preventing slippage of fingers of the human player or operator when rotating the retaining nut 85.

In the tension adjustment mechanism 100-2 in the second embodiment, the tension adjustment of the coil spring 60 is adjusted by rotating the adjusting nut 70 to thereby move the connection ring 90 upward or downward until the coil spring 60 assumes desired tension. Once the tension of the coil spring 60 is set, the retaining nut 85 is tightened to sandwich the connection ring 90 between the adjusting nut 70 and the retaining nut 85 and thereby position (fix) the connection ring 90.

Because the tension adjustment mechanism 100-2 in the second embodiment is constructed in such a manner that the connection ring 90 is sandwiched between the adjusting nut 70 and the retaining nut 85 as noted above, the tension adjustment mechanism 100-2 can prevent positional displacement of the connection ring 90 more reliably although it is simple in construction. Further, because the tension of the coil spring 60 can be adjusted via the adjusting nut 70 located above the engaged position (connection position) between the coil spring 60 and the connection ring 90, the tension adjusting operation can be performed with ease.

Further, in the tension adjustment mechanism 100-2, a holding plate (holding member) 24 is provided for holding and supporting from below the pin 66 abutting against the receiving portions 23*f* of the support section 23. The holding plate 24 is mounted by being inserted in slits 23*h* formed in opposite inner side surface portions of the support section 23. In this manner, the pin 66 abutting against the receiving portions 23*f* of the support section 23 can be held and supported so as not to be displaced downward, and thus, the adjusting bolt 65 can be preventing from accidentally falling, when the adjusting nut 70 and the connection ring 90 is dismounted from the adjusting bolt 65. As a consequence, the tension adjustment mechanism 100-2 can be assembled and maintained with an increased ease and efficiency. Besides, the pivoting or swinging of the adjusting bolt 65 about the abutment section 97 can be stabilized.

Third Embodiment

Figure 11:
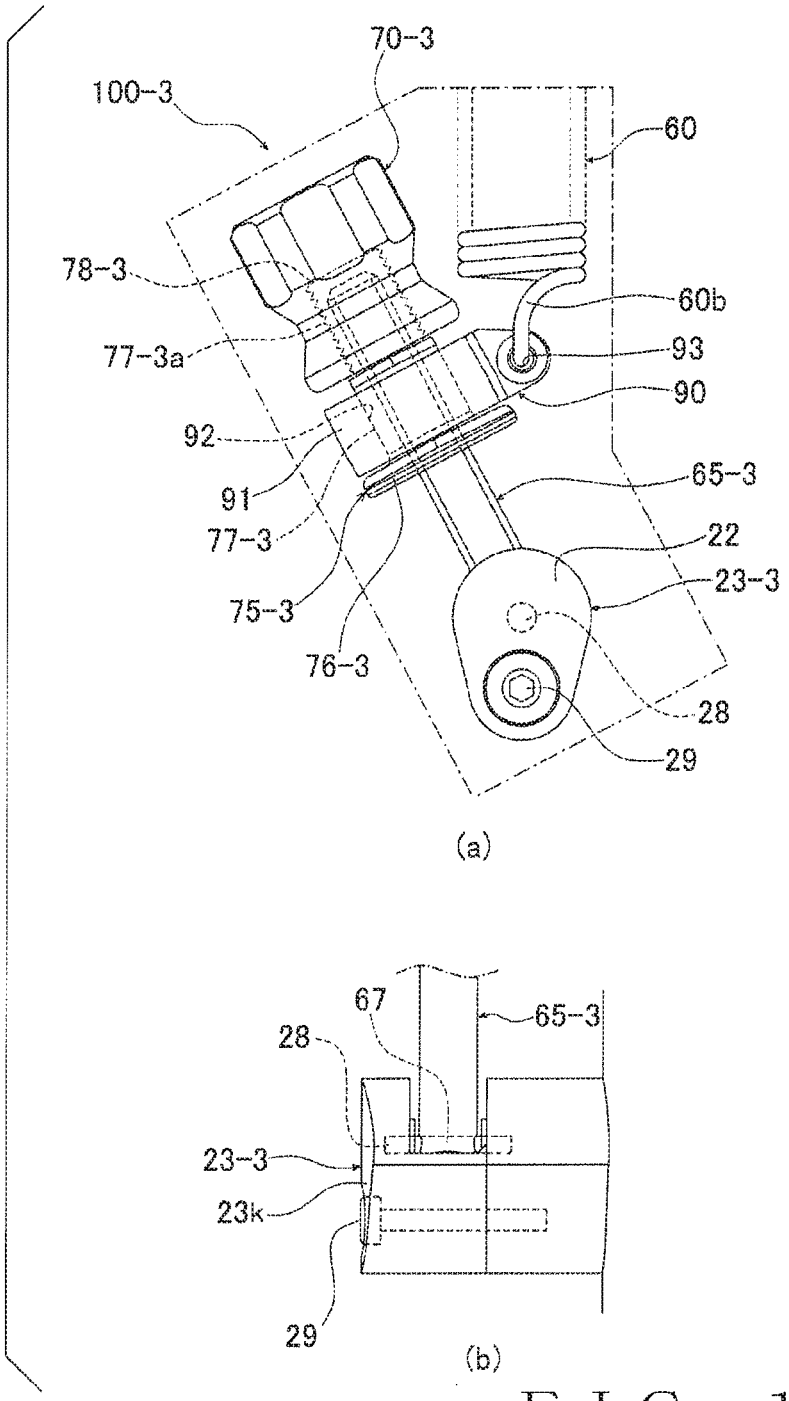
FIG. 11 is a view showing a tension adjustment mechanism provided in a third embodiment of the drum foot pedal apparatus of the present invention.
Figure 12:
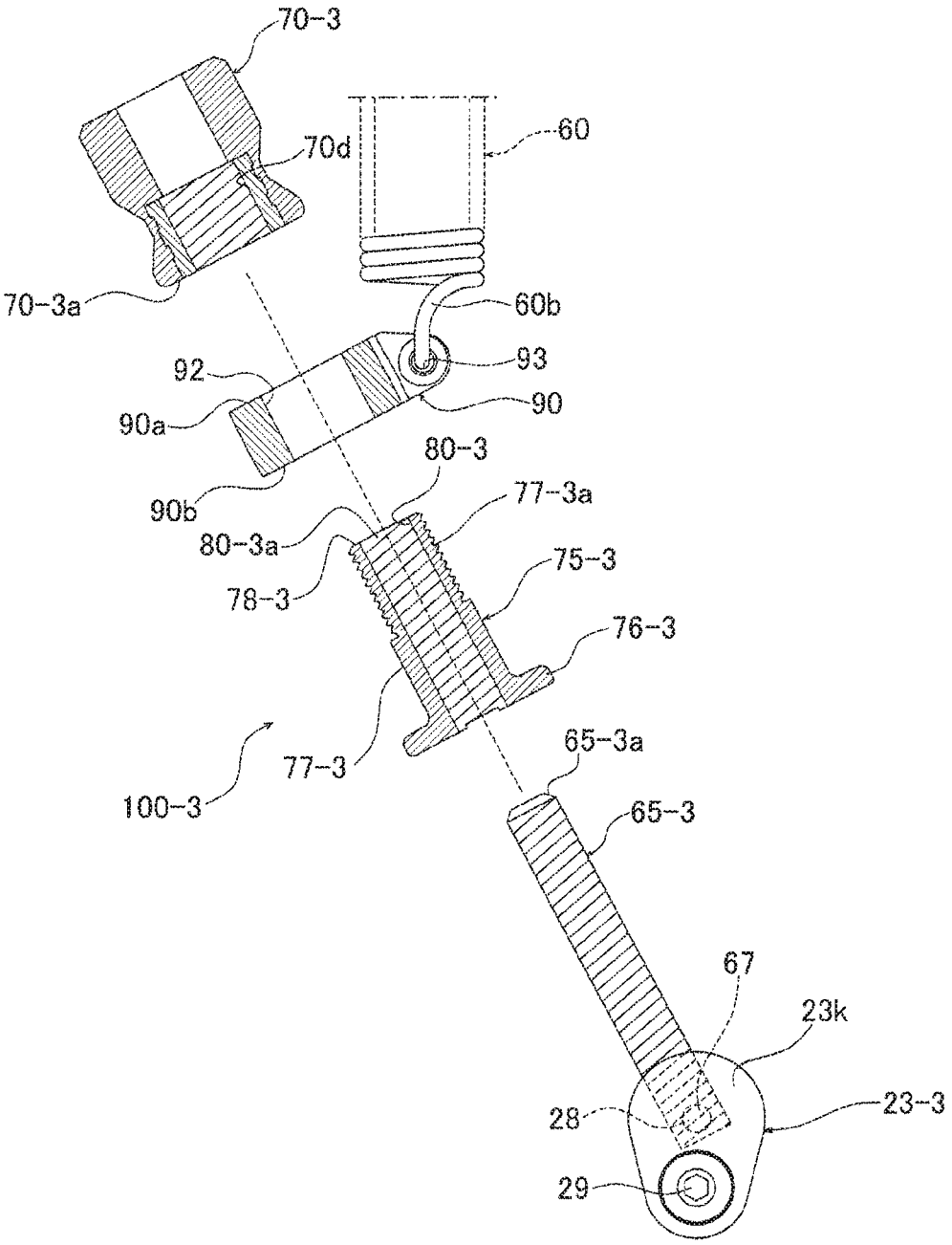
FIG. 12 is an exploded sectional side view showing various component parts of a tension adjustment mechanism in the third embodiment.

The following describe a third embodiment of the present invention with reference to FIGS. 11 and 12. FIG. 11 is a fragmentary enlarged view showing a tension adjustment mechanism 100-3 provided in the third embodiment of the drum foot pedal apparatus of the present invention, and FIG. 12 is an exploded sectional side view showing various component parts of the tension adjustment mechanism 100-3. Whereas the tension adjustment mechanism 100 in the first embodiment includes the slide bush 75 axially slidably mounted on the adjusting bolt 65 and the adjusting nut 70 mounted in threaded engagement with the adjusting bolt 65, the tension adjustment mechanism 100-3 in the third embodiment includes, in place of the above-mentioned slide bush 75, a bush member 75-3 mounted in threaded engagement with an adjusting bolt 65-3. An adjusting nut 70-3 threadedly engages with the bush member 75-3.

More specifically, the bush member 75-3 in the third embodiment has a screw section (internally threaded section) 80-3*a* formed in the inner peripheral surface of a through-hole 80-3 of the bush member 75-3 for threaded engagement with the adjusting bolt 65. The shaft section 77-3 has a screw section (externally threaded section) 77-3*a* formed on a portion of its outer peripheral surface extending from a distal end portion 78-3 of the shaft section 77-3 toward a base section 76-3 for threaded engagement with the adjusting nut 70-3. The shaft section 77-3 of the bush member 75-3 is inserted from below through the through-hole 92 of the connection ring 90. With the shaft section 77-3 inserted through the through-hole 92 as above, the base section 76-3 of the bush member 75-3 abuts against the lower end surface 90*b* of the connection ring 90, and a distal end portion (a portion of the screw section 77-3*a*) projects beyond the upper end surface 90*a* of the connection ring 90. In such conditions, the adjusting nut 70-3 is screwed onto the portion of the screw section 77-3*a* projecting beyond the upper end surface 90*a* of the connection ring 90, so that the connection ring 90 is sandwiched between the lower surface 70-3*a* of the adjusting nut 70-3 and the base section 76-3 of the bush member 75-3.

With the tension adjustment mechanism 100-3 in the third embodiment, the human operator or player adjusts the axial position of the bush member 75-3 relative to the adjusting bolt 65-3 by rotating the bush member 75-3 threadedly engaging with the adjusting bolt 65-3. In this manner, it is possible to adjust the position mounted on the shaft section 77-3 of the bush member 75-3 to a desired position. Upon completion of the positioning of the bush member 75-3, the human operator or player fixes the connection ring 90 to the bush member 75-3 by tightening the adjusting nut 70-3.

Further, whereas the tension adjustment mechanism 100 in the first embodiment of the invention includes the abutment section 97 where the pivot point section of the adjusting bolt 65 abuts against the receiving portions 23*f* of the support section 23, the tension adjustment mechanism 100-3 in the third embodiment includes, in place of the abutment section 97, a structure where a near-lower-end portion of the adjusting bolt 65-3 is pivotably supported by the support section 23-3. Namely, the support section 23-3 in the third embodiment includes a bracket 23*k* fixed by a screw 29 to a side surface portion of the support post member 21, and a shaft member 28 extends, through a through-hole 67 formed in the adjusting bolt 65-3, between the bracket 23*k* and the side surface portion of the support post member 21 and is fixed at its opposite ends to the bracket 23*k* and the side surface of the support post member 21. By the shaft member 28 extending through the through-hole 67 formed in the adjusting bolt 65-3, the adjusting bolt 65-3 is supported by the shaft member 28 in such a manner that it is pivotable about the shaft member 28.

Thus, in the tension adjustment mechanism 100-3 in the third embodiment, the adjusting bolt 65-3 pivots or swings in the front-rear direction of the foot board 50 about the shaft section 28 as the coil spring 60 expands and contracts in response to pivoting of the arm section 38. Further, because the tension of the coil spring 60 can be adjusted via the adjusting nut 70-3 located above the engaged position (connection position) between the coil spring 60 and the connection ring 90, the tension adjusting operation can be performed with ease.

Fourth Embodiment

Figure 13:
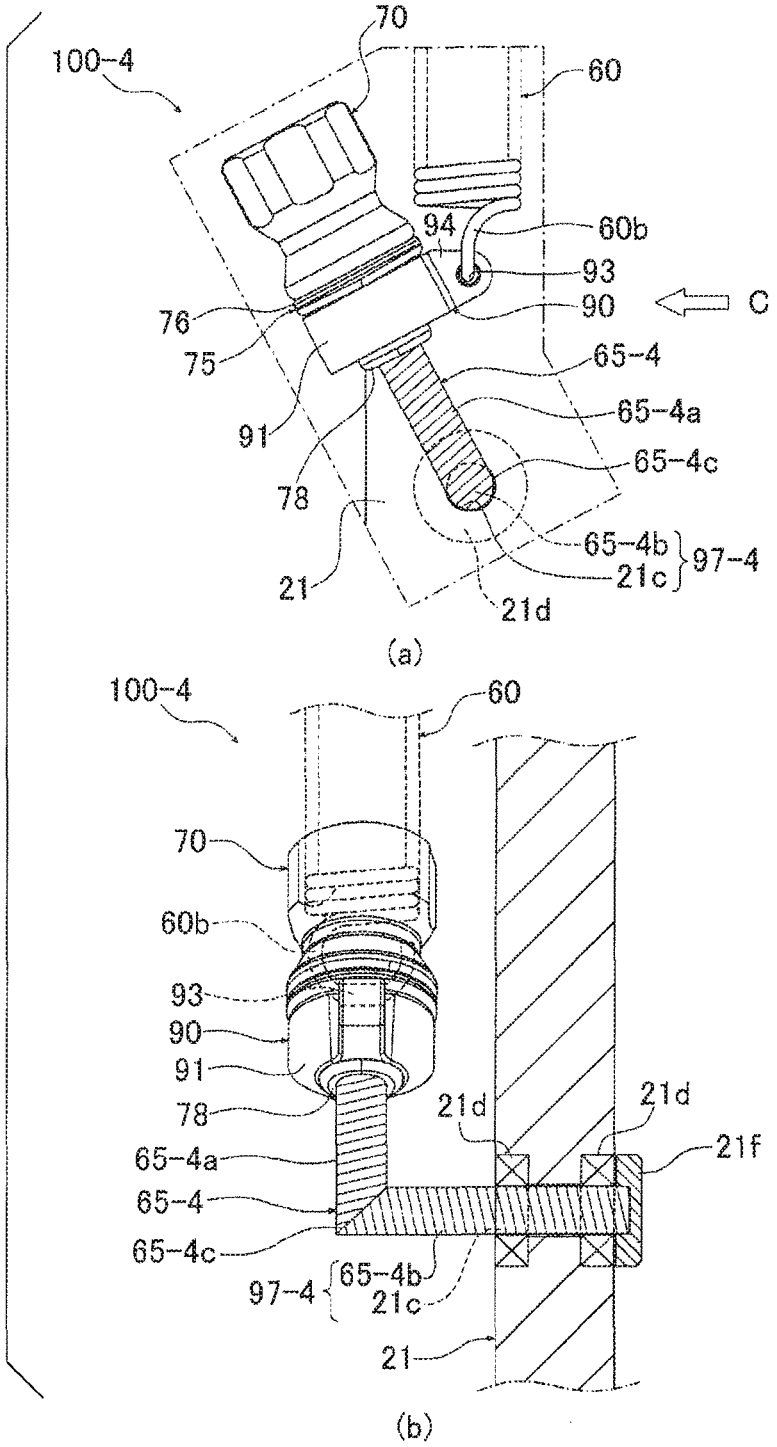
FIG. 13 is a view showing a tension adjustment mechanism provided in a fourth embodiment of the drum foot pedal apparatus of the present invention.

The following describe a fourth embodiment of the drum foot pedal apparatus of the present invention with reference to FIG. 13. Of FIG. 13, (a) is a side view of a tension adjustment mechanism 100-4 in the fourth embodiment, and (b) is a view (partly in section) taken in a direction arrow C. Note that, for convenience of illustration, the entire coil spring 60 is depicted in broken line in (a) of FIG. 13. Whereas the tension adjustment mechanism 100 in the first embodiment of the invention includes the abutment section 97 where the pivot point section of the adjusting bolt 65 abuts against the receiving portions 23*f* of the support section 23, the tension adjustment mechanism 100-4 in the fourth embodiment includes, in place of the abutment section 97, an adjusting bolt 65-4 bent by 90 degrees at a longitudinally intermediate position thereof, and the tension adjustment mechanism 100-4 also includes a structure where a distal end portion 65-4*b* of the adjusting bolt 65-4 is supported directly by a through-hole 21*c* of the support post member 21. More specifically, the adjusting bolt 65-4 in the fourth embodiment, which is formed in a substantially L overall shape, includes a bent section 65-4*c*, a body section 65-4*a* extending upward from (closer to the proximal end than) the bent section 65-4*c*, and a distal end section 65-4*b* extending laterally from the bent section 65-4*c* toward the support post member 21. The support post member 21, on the other hand, has the through-hole 21*c* formed in its side surface for insertion therethrough of the distal end section 65-4*b* of the adjusting bolt 65-4, and the distal end section 65-4*b* of the adjusting bolt 65-4 is rotatably supported in the through-hole 21*c* via a bearing 21*d*. A retaining nut 21*f* is mounted on a portion of the distal end section 65-4*b* of the adjusting bolt 65-4 projecting beyond the through-hole 21*c* formed in the support post member 21, so that the distal end section 65-4*b* can be prevented from slipping out of the through-hole 21*c*. In the aforementioned manner, the adjusting bolt 65-4 is supported in such a manner that it can swing or pivot about a pivot point section 97-4 constituted by the distal end section 65-4*b* of the adjusting bolt 65-4 and the through-hole 21*c* of the support post member 21.

Thus, with the tension adjustment mechanism 100-4 in the fourth embodiment too, the tension of the coil spring 60 can be adjusted via the adjusting nut 70-4 located above the engaged position (connection position) between the coil spring 60 and the connection ring 90, and thus, the tension adjusting operation can be performed with ease. Further, the adjusting bolt 65-4 pivots or swings in the front-rear direction (longitudinal direction) of the foot board 50 about the pivot point section 97-4 as the coil spring 60 expands and contracts in response to pivoting of the arm section 38.

It should be appreciated that the present invention is not limited to the above-described embodiments and may be modified variously within the scope of the technical idea disclosed in the claims, specification and drawings. For example, whereas the first embodiment of the present invention has been described above as having, as an example of the pivot support section, the structure comprising the support point section in the form of a projection (pin 66) provided on the adjusting bolt 65 and the receiving portions 23*f* in the form of curved recesses provided in the support section 23, the present invention is not so limited, and a support point section in the form of a projection may be provided on the support section and received in receiving portions formed in the adjusting bolt. Further, the specific shape of the receiving portions may be other than a curved shape, such as a flat shape.

Furthermore, whereas the embodiments of the invention each have been described as constructed in such a manner that the adjusting bolt pivots relative to the support post member, the present invention is not so limited, and the adjusting bolt may be fixed (non-displaceable) relative to the support post member. For example, whereas the fourth embodiment has been described above in relation to the case where the L-shaped bolt is pivotable relative to the support post member via the bearing 21, the L-shaped bolt may be fixed by being screwed directly to the support post member, and the connection ring and the adjusting nut may be mounted on such a fixed bolt so that the tension of the coil spring 60 is adjustable by adjusting the position of the connection ring.

Furthermore, whereas the positional displacement prevention mechanism 95 in the present invention has been described above as comprising the projection section 71 provided on the lower end surface 70*a* of the adjusting nut 70 and the groove section 82 provided in the upper end surface 76*b* of the slide bush 75. Conversely, such a groove section may be provided in the lower end surface 70*a* of the adjusting nut 70, and the projection section may be provided on the upper end surface 76*b* of the slide bush 75.

In addition, whereas the above-described embodiments are constructed to adjust the position of the connection ring by means of the adjusting bolt and the adjusting nut, the present invention is not necessarily limited to such a bolt-and-nut structure. For example, a rod-shaped member (rod member) with no thread (non-threaded rod member) may be pivotably supported by the support post member, and a detachable pin may be engaged in a portion of such a rod member above the connection ring so that the connection ring can be restricted in position by the pin. In such a case, a plurality of pin-engaging or -inserting holes may be formed in the rod member at different distances from the pivot point so that the connection ring can be positioned at any desired position by the pin being engaged in a selected one of the pin-inserting holes. In the illustrated example of FIG. 5, for instance, the adjusting bolt 65 may be replaced by a non-threaded rod member, and the non-threaded rod member is supported at one end by the support post member 21 and extends obliquely upward in a similar manner to the adjusting bolt 65. Further, a plurality of pin-inserting holes may be formed in the rod member, and the connection position adjustment section may comprise a combination of the connection ring (connection member) 90 and the pin-inserting holes; in this case, the adjusting nut 70 and the slide bush 75 are not essential and may be dispensed with. The pin is inserted in a desired one of the plurality of pin-inserting holes, and, by the inserted pin abutting against the upper end of the upwardly-spring-biased connection ring (connection member) 90, the connection ring 90 is positioned in such a manner that it is movable axially along the rod member as desired.

This application is based on, and claims priority to, Japanese Patent Application No. 2016-61835 filed on 25 Mar. 2016. The disclosure of the priority application, in its entirety, including the drawings, claims, and the specification thereof, are incorporated herein by reference.

What is claimed is:

1. A drum foot pedal apparatus comprising:

a support post member that supports a pivot shaft having a beater mounted thereto;

a transmission member that interconnects the pivot shaft and a foot board;

an arm section provided on one end portion of the pivot shaft;

a coil spring having an upper end mounted to the arm section for imparting resilient self-returning force to the foot board; and a tension adjustment mechanism configured to adjust tension of the coil spring, the tension adjustment mechanism including:

a guide post supported by and pivotable relative the support post member;

a connection member freely movable relative to and longitudinally along the guide post, and connected to a lower end of the coil spring, which is disposed above a support position where the guide post is supported by the support post member; and an operating member movable relative to the guide post to adjustably move the connection member longitudinally along the guide post to displace the lower end of the coil spring relative to the upper end of the coil spring to adjust the tension of the coil spring, while maintaining the lower end of the coil spring at a position above the support position, wherein the operating member has an operating section operable by a user to move the operating member, the operating section being disposed above the lower end of the spring.

2. The drum foot pedal apparatus as claimed in claim 1, wherein:

the guide post is a rod member having a threading supported at one end by the support post member, and the connection member is longitudinally movable along the rod member.

3. The drum foot pedal apparatus as claimed in claim 2, wherein the rod member is an adjusting bolt.

4. The drum foot pedal apparatus as claimed in claim 3, wherein:

the connection member is mounted on the adjusting bolt for movement along the adjusting bolt, and the operating member includes an adjusting nut threadedly engaging with a portion of the adjusting bolt above the connection member.

5. The drum foot pedal apparatus as claimed in claim 3, wherein the adjusting bolt is pivotably supported at the one end by the support post member.

6. The drum foot pedal apparatus as claimed in claim 4, wherein the tension adjustment mechanism further includes a positional displacement prevention mechanism that prevents positional displacement of the connection member relative to the adjusting bolt.

7. The drum foot pedal apparatus as claimed in claim 6, wherein:

the positional displacement prevention mechanism includes a projection section provided on one of the adjusting nut and an abutment member abutting against the adjusting nut, and a groove section provided in other of the adjusting nut and the abutment member, and the positional displacement prevention mechanism prevents rotation of the adjusting nut and positional displacement of the connection member by the projection section fitting in the groove section, as long as the adjusting nut is at a predetermined rotational angle position.

8. The drum foot pedal apparatus as claimed in claim 6, wherein:

the positional displacement prevention mechanism includes a retaining nut provided opposite the adjusting nut in the axial direction of the adjusting bolt with respect to the connection member, and the positional displacement prevention mechanism prevents a positional displacement of the connection member by sandwiching the connection member between the adjusting nut and the retaining nut.

9. The drum foot pedal apparatus as claimed in claim 2, wherein the tension adjustment mechanism comprises:

a pivot point support provided between the rod member and the support post member, wherein the rod member is a bolt that pivots about the pivot point support as the coil spring expands and contracts in response to pivoting of the arm section.

10. The drum foot pedal apparatus as claimed in claim 2, wherein the operating member comprises a positioning member that positions the connection member at a desired position along a length of the rod member.

11. The drum foot pedal apparatus as claimed in claim 4, wherein the connection member comprises:

an annular body mounted around an outer periphery of the adjusting bolt; and an engaging section disposed in an outer peripheral surface of the annular body and engaging a lower hook portion of the coil spring.

12. The drum foot pedal apparatus as claimed in claim 5, wherein the rod member pivots relative to the support post member as the coil spring expands and contracts in response to pivoting of the arm section.

* * * * *